US011585519B2

(12) United States Patent
Berrel et al.

(10) Patent No.: US 11,585,519 B2
(45) Date of Patent: Feb. 21, 2023

(54) HEADLAMP HEADBAND

(71) Applicant: Zedel, Crolles (FR)

(72) Inventors: Philippe Berrel, La Chapelle du Bard (FR); Raphael Bortolotti, Annecy le Vieux (FR); Mathieu Le Bourhis, Crets-en-Belledonne (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 17/676,514

(22) Filed: Feb. 21, 2022

(65) Prior Publication Data

US 2022/0268429 A1 Aug. 25, 2022

(30) Foreign Application Priority Data

Feb. 23, 2021 (EP) ..... 21158833

(51) Int. Cl.

| | |
|---|---|
| ***F21V 23/00*** | (2015.01) |
| ***F21S 9/02*** | (2006.01) |
| ***F21V 21/084*** | (2006.01) |
| ***F21V 23/06*** | (2006.01) |

(52) U.S. Cl.

CPC ..... *F21V 23/002* (2013.01); *F21S 9/02* (2013.01); *F21V 21/084* (2013.01); *F21V 23/06* (2013.01)

(58) Field of Classification Search

CPC ..... F21V 23/002; F21V 21/084; F21V 23/06; F21V 21/0816; F21V 21/0885; F21S 9/02

See application file for complete search history.

(56) References Cited

U.S. PATENT DOCUMENTS

| | | | | |
|---|---|---|---|---|
| 7,918,578 | B2 * | 4/2011 | Spartano | F21V 29/89 362/373 |
| 9,707,707 | B2 * | 7/2017 | Ferguson | A61B 90/35 |
| 2005/0276036 | A1 * | 12/2005 | Miles | F21L 4/02 362/105 |
| 2012/0195026 | A1 | 8/2012 | Bouffay et al. | |
| 2012/0250295 | A1 | 10/2012 | Jarzac et al. | |
| 2014/0226264 | A1 * | 8/2014 | Davidson | F21V 21/084 361/679.01 |
| 2020/0208818 | A1 | 7/2020 | Le Bourhis et al. | |

FOREIGN PATENT DOCUMENTS

| | | |
|---|---|---|
| EP | 2 481 981 A1 | 8/2012 |
| EP | 2 505 907 A1 | 10/2012 |
| EP | 3 674 596 A1 | 7/2020 |

* cited by examiner

*Primary Examiner* — Peggy A Neils
(74) *Attorney, Agent, or Firm* — Saile Ackerman LLC; Stephen B. Ackerman

(57) ABSTRACT

A headlamp with a headband is presented. The headlamp includes:

a headband element to receive a lamp body, and a passing hole or vertical conduit for the sliding passage of a tightening elastic link and an attachment clip to make a horizontal sliding connection with an electrically conductive cord, a rear part with a support to hold an electric battery and a locking lever;

an electrical conductor cord having two radii of curvature so as to form a "Z";

a movable clip positioned at the first radius of curvature to ensure sliding of said electrically conductive cord with the upper part of the tightening elastic link;

a second movable clip positioned at the level of the second radius of curvature to allow the electrically conductive cord to slide with the lower part of said tightening elastic link.

8 Claims, 7 Drawing Sheets

HEADLAMP HEADBAND

TECHNICAL FIELD

The present invention relates to the field of headlamps and in particular a headband for a headlamp.

BACKGROUND

There are many types of headlamp headbands. The huge development of the most recent headlamps has led to the design of particularly sophisticated headbands so as to allow the support, not only of a headlamp located at the front of a user's head, but also of a bulky battery which is located at the rear of the headlamp and which provides the power supply of the latter.

FIG. 1 shows an example of a well-known solution used for a high-power lamp marketed by the Applicant of the present patent application. It shows a headband comprising two parts, namely a first part 110 located at the front, on which is fixed a headlamp housing 100, and a second part located at the rear. The second part comprises a support 140 allowing the holding of an electric battery 150, and a link 130*a*/130*b* allowing the connection to be made between the front part 110 and the support 140 of the rear part. A locking device 170 makes it possible to block the link in an adjustable manner to ensure the adjustment of the assembly to various head shapes and even a helmet.

The electrical connection between the battery 150 and the headlamp housing 100 is made by means of an electrical conductor 160 which, to provide various adjustment configurations, is in the form of a twist or a spiral 160 allowing the stretching of the headband when the latter must be attached to a large head, or even a safety helmet. It has been noticed that the known solution of FIG. 1 has a certain number of drawbacks.

Firstly, significant discomfort was noted related to the tension of the spiral electrical conductor 160—the spring force of which is necessary to ensure minimal aesthetic support of the electrical conductor—and which pulls on one side of the headband. This spring force is perceived very clearly as an annoyance by the wearer of the lamp who must also refocus it at regular intervals when he embarks on an intense activity such as running.

Secondly, as seen in the figure, the spiral electrical conductor 160 is relatively bulky and cumbersome and detrimental not only to the aesthetics of the entire headband, but also to its compactness.

SUMMARY

In general, we are looking for a support solution that is more discreet, more comfortable and more elegant, while ensuring the possibilities of adjusting the headband on a wide variety of heads and even on a safety helmet.

This is the problem to be solved by the present invention.

It is an object of the present invention is to propose a new headband structure intended for holding a headlamp, ensuring the electrical connection between a headlamp housing located at the front and a power supply battery located at the rear while reducing the effect of electric cable tension perceptible to the user.

It is another object of the present invention to provide a headlamp structure which is compact, and which allows adjustment to different head sizes and even a safety helmet.

It is a further object of the present invention to provide a headlamp headband structure having two parts, respectively front and rear, attached by an adjustment link.

The invention achieves such objects by means of a new arrangement for a headlamp comprising a front part and a rear part.

FIG. 2 shows the front part (205) which comprises a headband element configured to receive a lamp body and which comprises two terminations comprising each a passing hole or vertical conduit configured for the sliding passage of a tightening elastic link. One termination further comprises a first attachment clip-projecting to make a horizontal sliding connection with an electrically conductive cord (270).

The rear part comprises a support intended to hold an electric battery and a locking lever. The support comprises at its base two attachment points—respectively left and right—for two ends of the tightening elastic link and two through holes in its upper part to ensure the passage of said tightening elastic link which can be blocked by said locking lever (260).

In accordance with the invention, the tightening elastic link is configured to pass successively from the left attachment point on the base of the support of the rear part, to then run towards the vertical conduit of a first termination to come out of it and go to join the upper left through hole of the support of the rear part to form therein an adjustable and lockable loop by said locking lever. On the right side, the tightening elastic link comes out through the upper right through hole of the support of the rear part, to join the vertical conduit of a second termination and then join the right attachment on the base of the support of the rear part.

The headband further comprises an electrical conductor cord having two radii of curvature so as to form a "Z";

a first movable clip positioned at the first radius of curvature to ensure sliding of the electrically conductive cord with the upper part of the tightening elastic link; a second movable clip positioned at the level of the second radius of curvature to allow said electrically conductive cord to slide with the lower part of said tightening elastic link.

In one embodiment, one termination provides a double sliding connection, perpendicular to each other, for the electrical cord and said tightening elastic link.

In another embodiment, the two terminations are preferably made by molding or by sewing on the elastic headband forming the front part.

Preferably, the terminations have the shape of a substantially square or rectangular loop, one hollow vertical side of which serves as a passage conduit for vertical sliding said tightening elastic link.

BRIEF DESCRIPTION OF THE DRAWINGS

Other characteristics, object and advantages of the invention will appear on reading the description and the drawings below, given solely by way of non-limiting examples. On the attached drawings.

DESCRIPTION

Figure 1:
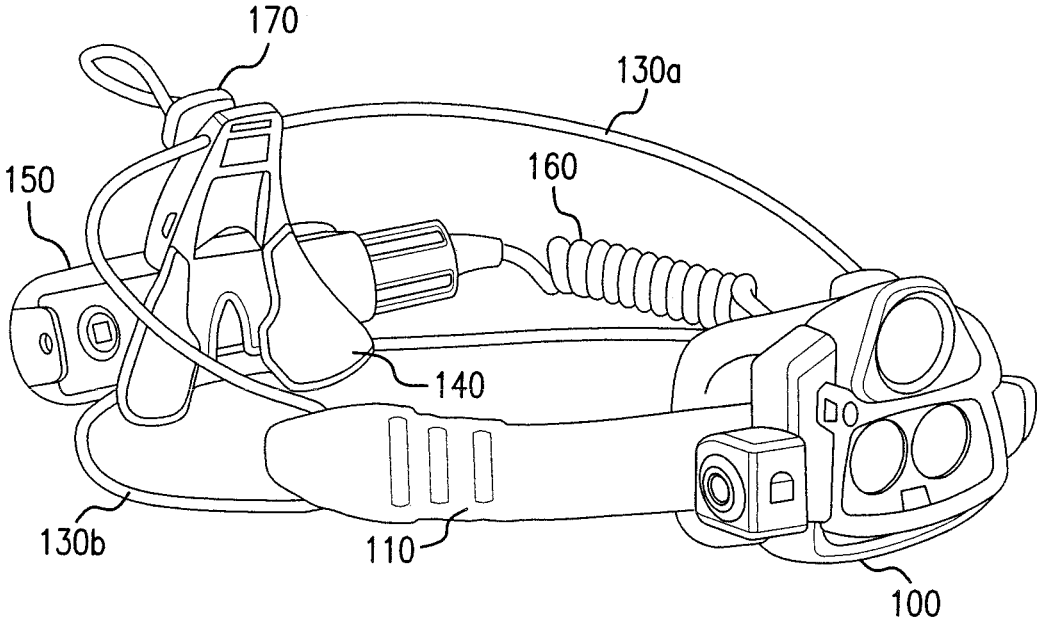
FIG. 1 Prior Art
FIG. 1 illustrates a state-of-the-art headlamp allowing the electrical connection between a lamp housing located at the front and a power supply battery located at the rear.
Figure 2:
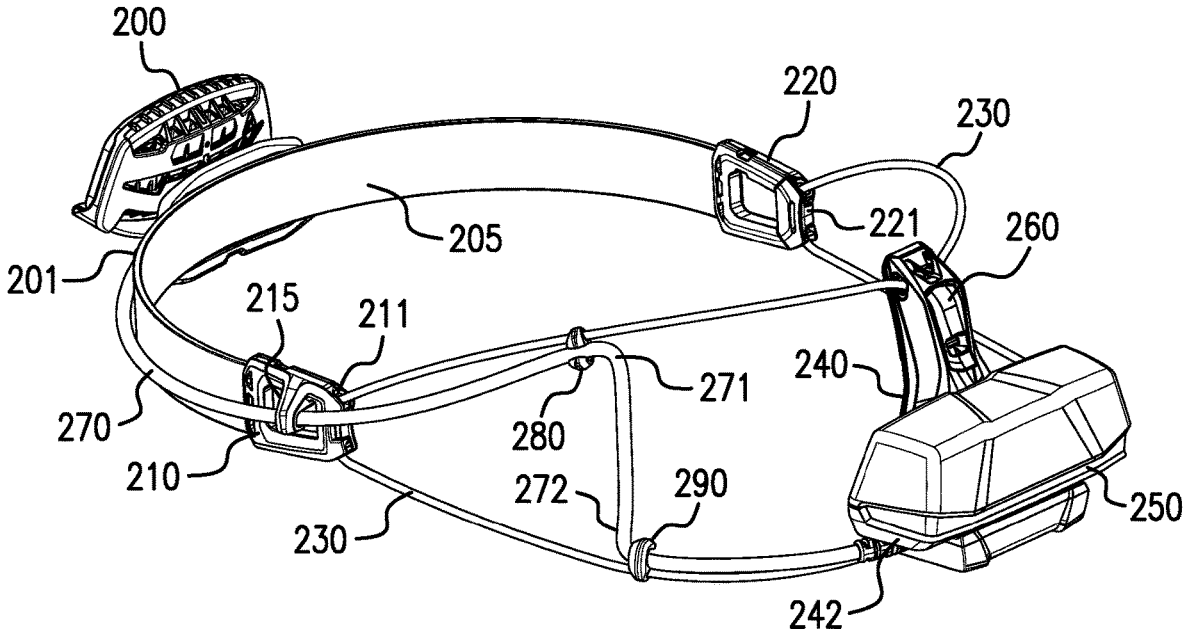
FIG. 2 illustrates a rear perspective of an embodiment of a headlamp headband in accordance with the present invention.
Figure 3:
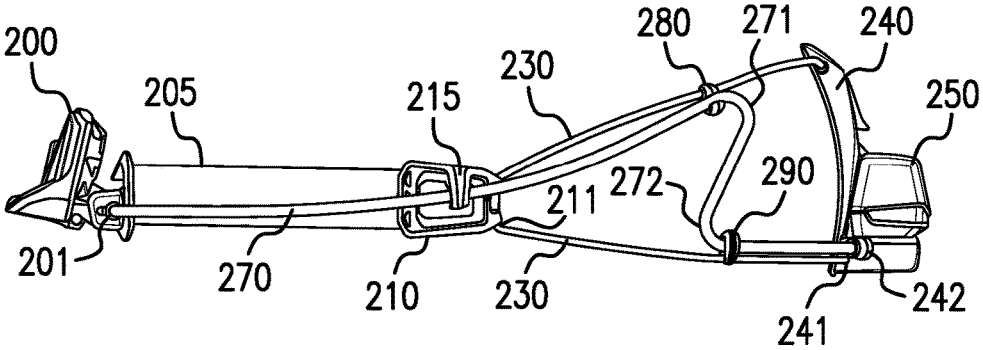
FIG. 3 shows a left view of the embodiment of FIG. 2, in minimal development configuration.
Figure 4:
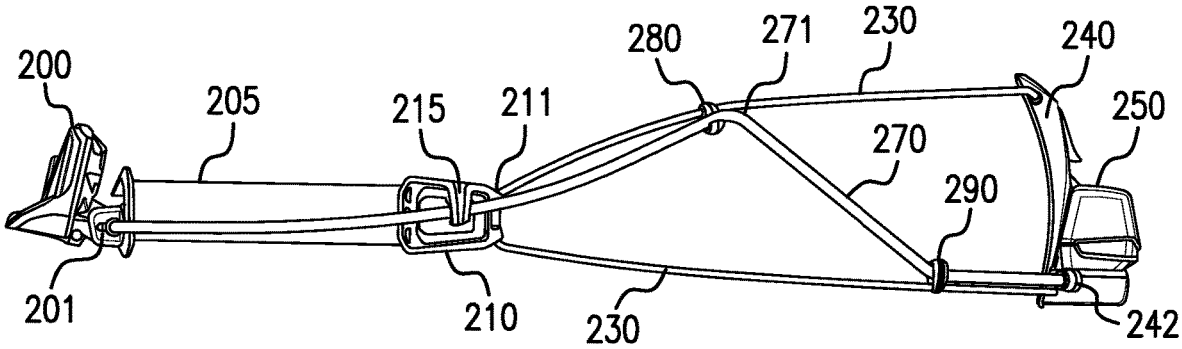
FIG. 4 shows a left view of the embodiment of FIG. 2 in maximum development configuration.

FIG. 2 illustrates a left rear perspective of a preferred embodiment of a retaining band according to one embodiment of the invention, and which illustrates the various constituent elements thereof. FIGS. 3 and 4 illustrate left views according to two development positions of the electrical wire.

As seen in FIG. 2, the headband has a front part 205 and a rear part 240, connected to each other by means of a tightening elastic link 230.

The front part 205 is in the form of a headband element, made of textile, plastic or any other suitable material, preferably elastic, on which a lamp body 200 will be fixed. Different fixing methods can be envisaged to ensure maintaining the housing ZE-22-001 6 200 on the front part 205 that it is not necessary to detail here for the sake of conciseness. It suffices to mention, for example, the possibility of providing two holes in the lamp body 200 for the passage of the headband element of front part 205 so as to ensure a sliding connection of the lamp body 200 on the latter. But, clearly, other embodiments are possible and conceivable.

The headband element of front part 205 comprises two ends respectively left and right, to which are fixed, preferably by overmolding or sewing, two plastic terminations 210 and 220 each having a through hole or vertical conduit, respectively 211 and 221, intended for the sliding passage of the tightening elastic link 230. Preferably, the plastic terminations 210 and 220 have the shape of a substantially square or rectangular loop, one hollow vertical side of which serves as a vertical conduit 211/221 for vertical sliding of tightening elastic link 230.

Figure 7A:
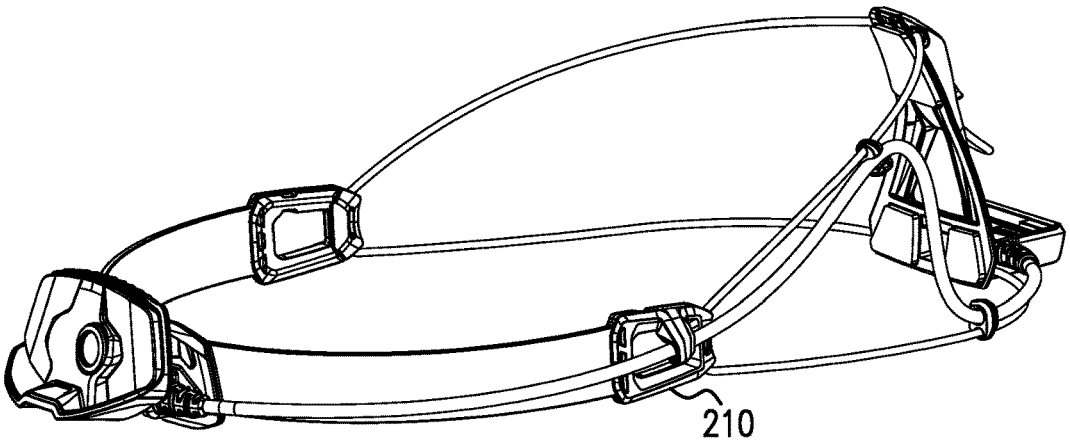
FIGS. 7A, 7B and 7C illustrate the detail of the ending part 210 allowing the sliding of the electrical wire 270.
Figure 7B:
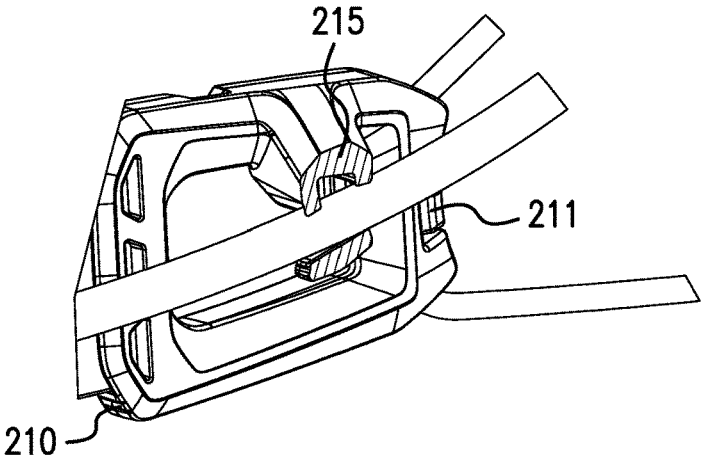
Figure 7C:
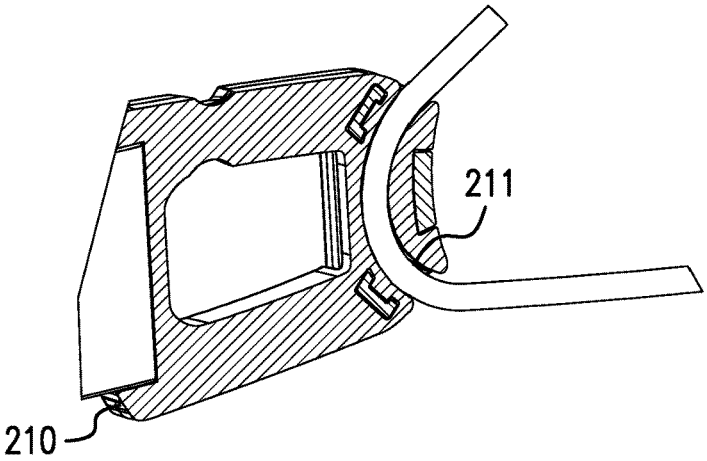
Figure 8A:
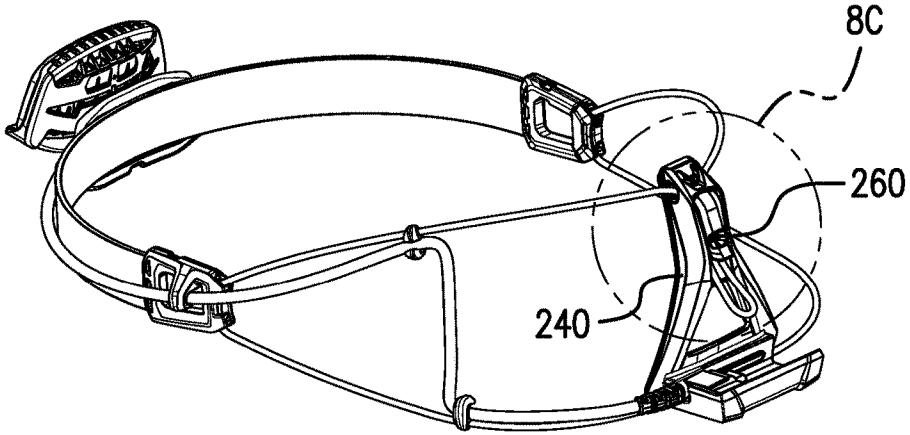
FIGS. 8A, 8B, 8C and 8D illustrate the detail of the locking lever 260 located on the support 240 at the rear of the headband.
Figure 8C:
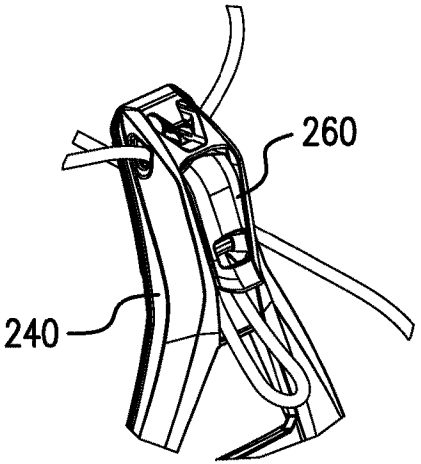
Figure 8D:
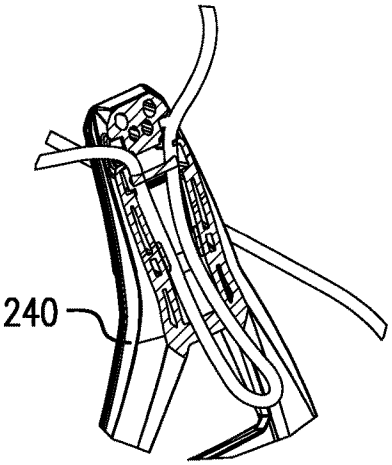
Figure 8B:
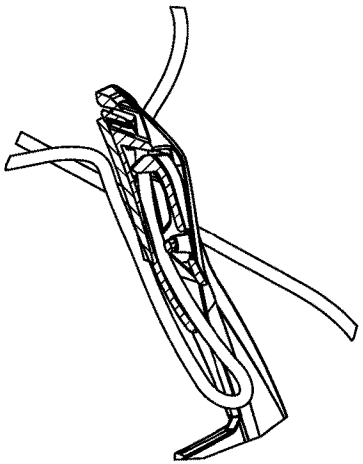

Furthermore, as seen in FIGS. 2, 3 and 4, plastic termination 210 further comprises a first attachment clip 215, arranged projecting, and which provides a horizontal sliding connection with an electrical wire 270. The detail of termination 210 is illustrated in FIGS. 7A-7C and will be described later.

This specific arrangement already makes it possible to observe that, at the level of plastic termination 210, a double sliding connection is thus provided, perpendicular to one another respectively for the electrical wire 270 (horizontal sliding) and the tightening link 230 (sliding vertical).

The rear part 240 of the headband consists of a support of substantially symmetrical shape in the median sagittal plane, and configured to match the rear shape of a user's head. Preferably the support is in the form of a triangle having a base provided with two attachment points, respectively left and right for the two ends of the tightening elastic link 230. FIG. 3 more particularly illustrates a left attachment point 241 of the tightening link 230, the right attachment point being not visible in the figure. The base of the rear part 240 also comprises a projection allowing the attachment of a battery body 250 connected to the electric wire 270 via a connector 242. On the upper part of rear part 240, two through holes are provided, respectively left and right, to ensure the passage of the tightening link 230 cooperating with a vertical locking lever 260 allowing the simultaneous locking on the two left and right sides of the tightening elastic link 230. FIG. 8 illustrates in more detail the rear part 240 and its locking lever 260.

As can be seen, the tightening possibilities of the proposed headband are significant due to the unique and particularly advantageous specific path of the tightening elastic link 230, which passes successively from the left attachment point 241 on the base of the support of rear part 240, then goes towards the left vertical conduit 211 of termination 210, leave it and join the upper left passing hole of the rear part 240 to form there an adjustable loop, as shown in FIGS. 8A-8D, and lockable by means of the vertical locking lever 260 and, on the right side, to come out through the upper right through hole of the support of rear part 240, and go to join the vertical sliding conduit 221 of termination 220 to then go to join the right attachment point of the base of rear part 240.

Such a course of the tightening elastic link 230 allows a particularly effective and comfortable holding on the head of a user since it leads to the appearance of a double tightening loop, respectively lower and upper, which can be tightened by means of a single vertical locking lever 260.

Furthermore, to make the electrical connection of the battery 250 to the lamp body 200, an electrical conductor cord 270 of very specific shape is provided with two radii of curvature, respectively 271 and 272 illustrated in FIG. 3, falling within a sagittal plane of the user so as to form a "Z" and cooperating advantageously with the course of the tightening elastic link 230.

For this purpose, two movable clips 280 and 290 are provided allowing a sliding connection between the electrically conductive cord 270 and the tightening elastic link 230. The movable clip 280 is positioned at the level of the first radius of curvature 271 to ensure sliding with the upper part of the elastic tightening link 230, while the mobile clip 290 is positioned at the level of the second radius of curvature 272 to allow sliding with the lower part of the tightening elastic link 230.

Figure 5A:
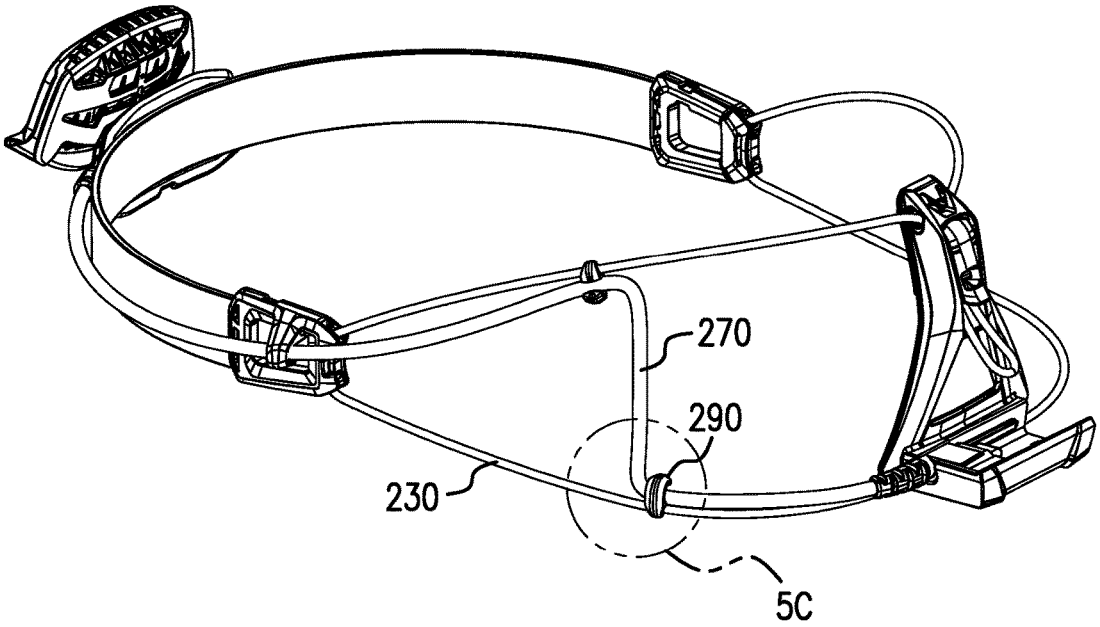
FIGS. 5A, 5B and 5C more particularly illustrate the detail of the clip 290 allowing the cooperation of the electrical wire 270 and the elastic link 230.
Figure 5B:
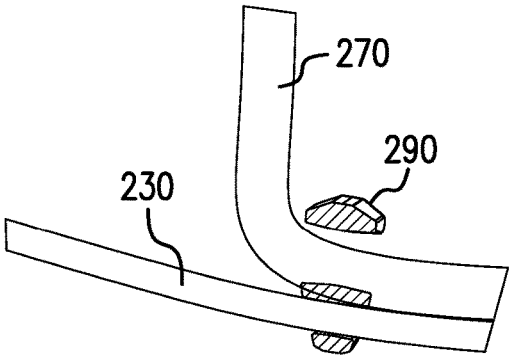
Figure 5C:
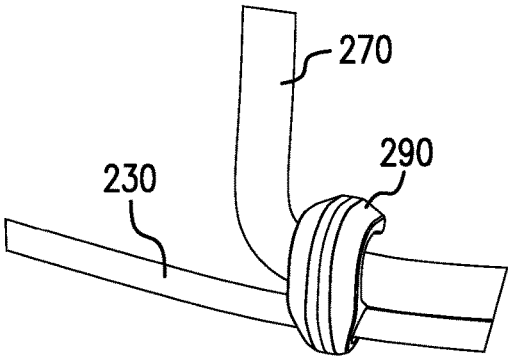
Figure 6A:
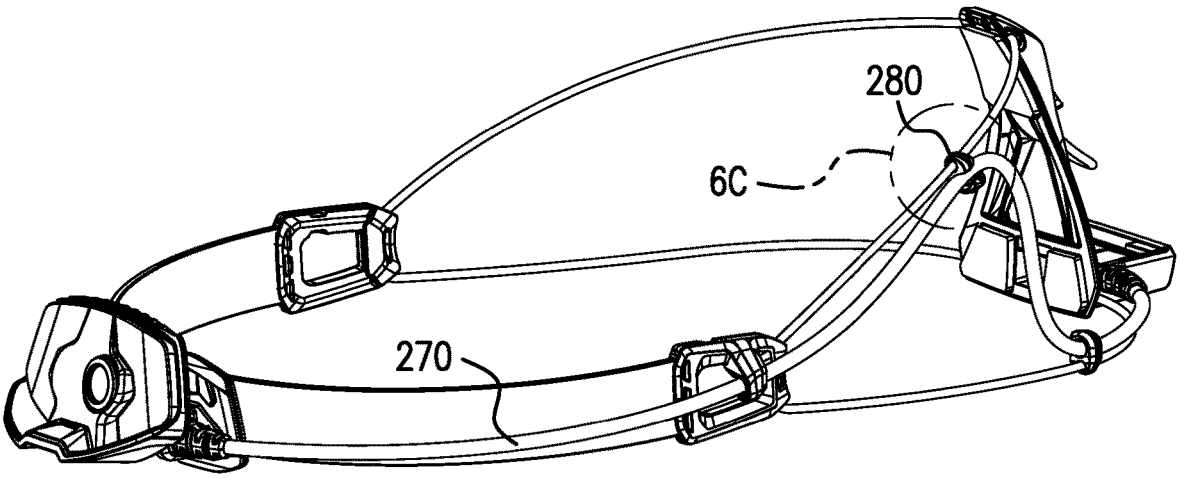
FIGS. 6A, 6B and 6C more particularly illustrate the detail of the clip 280 allowing the cooperation of the electrical wire 270 and the elastic link 230.
Figure 6B:
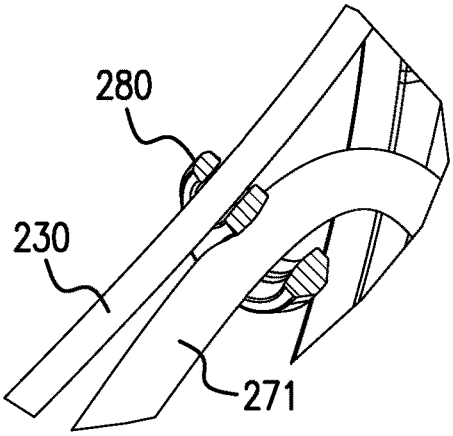
Figure 6C:
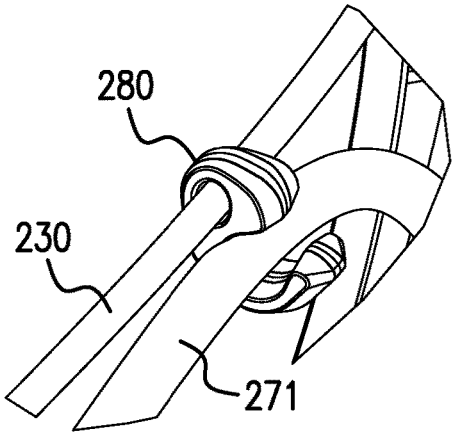

The detail of an embodiment of the mobile clip 290 is illustrated in FIGS. 5A-5C, while FIGS. 6A-6C show an embodiment of the mobile clip 280 allowing the cooperation of the electrical conductor cord 270 with the tightening elastic link 230.

The result is a sophisticated arrangement ensuring, with elegance, a great efficiency in maintaining the headband.

In summary, starting from the lamp body 200 to go to the battery 250, there are the following connections of the electrical conductor cord 270:

- the connector 201 for the electrical connection of the lamp body 200;
- a first sliding connection at the level of the first attachment clip 215, located projecting from the termination 210;
- a second sliding connection at the level of the second clip 280, close to the first radius of curvature, providing a double sliding connection with the upper part of the elastic tightening link 230 running towards the upper left hole of the support;
- a third sliding connection at the level of the third clip 290, close to the second radius of curvature, providing a double sliding connection with the lower part of the tightening elastic link 230 coming from the attachment point 241 of the support.

the connector 242 allowing the electrical coupling to the battery.

These sliding links cooperate with the sliding possibilities of the tightening elastic link 230 to ultimately allow wide adjustment possibilities, as shown in FIGS. 2 and 3 showing two distinct development configurations, respectively minimum and maximum.

It will be noted in particular, and advantageously, that the first termination 210 makes a double sliding connection, perpendicular to each other, at the level of the electrical cord 270 and the tightening link 230*a*/230*b*. Indeed, the attachment clip 215 allows a substantially horizontal sliding of the electrical cord 270 while the vertical conduit 211, 221 provide vertical sliding along the tightening elastic link 230.

In a preferred embodiment, the electric battery can be connected to the support 240 by means of a micro-USB type connector.

What is claimed is:

1. Headlamp comprising a headband which includes:

a front part comprising a headband element configured to receive a lamp body, and comprising two terminations, wherein each termination comprises a passing hole or vertical conduit configured for the sliding passage of a tightening elastic link and a first attachment clip projecting to make a horizontal sliding connection with an electrically conductive cord, a rear part comprising a support intended to hold an electric battery and a locking lever, wherein the support of said rear part comprises at its base two attachment points—respectively left and right—for two ends of said tightening elastic link and two through holes in its upper part to ensure the passage of said tightening elastic link which can be blocked by said locking lever;

said tightening elastic link being configured to pass successively from said left attachment point on the base of the support of said rear part, to then run towards said vertical conduit of a first termination to come out of it and go to join the upper left through hole of the support of said rear part to form therein an adjustable and lockable loop by said locking lever, wherein said tightening elastic link comes out through the upper right through hole of the support of said rear part, to join the vertical conduit of a second termination and then join the right attachment on the base of the support of said rear part.

an electrical conductor cord having two radii of curvature so as to form a "Z";

a first movable clip positioned at the first radius of curvature to ensure sliding of said electrically conductive cord with the upper part of said tightening elastic link;

a second movable clip positioned at the level of the second radius of curvature to allow said electrically conductive cord to slide with the lower part of said tightening elastic link.

2. The headlamp headband according to claim 1 characterized in that a termination provides a double sliding connection, perpendicular to each other, for the electrical cord and said tightening elastic link.

3. The headlamp headband according to claim 1 characterized in that said two terminations are preferably made by molding or by sewing on the elastic headband forming said front part.

4. The headlamp headband according to claim 1 wherein said terminations have the shape of a substantially square or rectangular loop, one hollow vertical side of which serves as a passage conduit for vertical sliding said tightening elastic link.

5. The headlamp headband according to claim 1 wherein the support of said rear part is in the form of a triangle having a base provided with two attachment points, respectively left and right, for the two ends of said tightening elastic link.

6. The headlamp headband according to claim 1 wherein the lamp body is pivotally attached to the headband.

7. The headlamp headband according to claim 1 wherein the lamp body has two through holes for the passage of the headband element.

8. The headlamp headband according to claim 1 wherein said support of the rear part comprises a Micro-USB type connector for connecting the electric battery.

* * * * *